US006686143B1

(12) United States Patent
Lok et al.

(10) Patent No.: US 6,686,143 B1
(45) Date of Patent: Feb. 3, 2004

(54) SILVER HALIDE PHOTOGRAPHIC ELEMENTS CONTAINING BIS AU(I) SENSITIZERS

(75) Inventors: Roger Lok, Rochester, NY (US); Brian P. Cleary, Webster, NY (US); Alton L. Chitty, Rochester, NY (US); Weimar W. White, Canaseraga, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/213,992

(22) Filed: Aug. 7, 2002

(51) Int. Cl.[7] ..... G03C 1/09

(52) U.S. Cl. ..... 430/605; 430/569; 430/600; 430/603; 430/611; 430/612

(58) Field of Search ..... 430/605, 603, 430/569, 600, 611, 612

(56) References Cited

U.S. PATENT DOCUMENTS

| | | | |
|---|---|---|---|
| 3,503,749 | A | 3/1970 | Tavernier et al. |
| 5,049,484 | A | 9/1991 | Deaton |
| 5,220,030 | A | 6/1993 | Deaton |
| 5,252,455 | A | 10/1993 | Deaton |
| 5,391,727 | A | 2/1995 | Deaton |
| 5,620,841 | A | 4/1997 | Lok et al. |
| 5,700,631 | A | 12/1997 | Lok et al. |
| 5,939,245 | A | 8/1999 | Lok et al. |
| 5,945,270 | A | 8/1999 | Lok et al. |
| 6,365,746 | B1 | 4/2002 | Lok et al. |

OTHER PUBLICATIONS

JP Abstract 8069053, Mar. 12, 1996.
U.S. application Ser. No. 10/214,031 of Brian P. Cleary et al, "Novel Bis Au(I) Sensitizers and Their Synthesis".

*Primary Examiner*—Thorl Chea
(74) *Attorney, Agent, or Firm*—Sarah Meeks Roberts

(57) ABSTRACT

This invention relates to a photographic element comprising a support and a silver halide emulsion layer, the emulsion layer comprising a water soluble Au(I) complex having the formula $$[L—Au—L]_n^- M^{+n}$$

wherein the complex is symmetrical; L is an organothiosulfonato ligand which is an antifogging, stabilizing, or sensitizing compound, n is 1 to 4, and M is a cationic counterion. This invention further relates to a silver halide photographic element comprising a support and a silver halide emulsion layer, the emulsion layer comprising an organothiosulfonato Au(I) complex having the formula $$[A—SO_2S—Au—SSO_2—A]_n^- M^{+n}$$

wherein

M is a cationic counterion;

A is a substituted or unsubstituted organic group;

and n is 1 to 4; and wherein the compound is symmetrical.

It further relates to a method of preparing a silver halide emulsion utilizing said organothiosulfonato Au(I) complexes.

30 Claims, No Drawings

SILVER HALIDE PHOTOGRAPHIC ELEMENTS CONTAINING BIS AU(I) SENSITIZERS

FIELD OF THE INVENTION

This invention relates to a photographic element containing an organothiosulfonato Au(I) complex. It farther relates to a method of sensitizing silver halide emulsions with such organothiosulfonato Au(I) complexes.

BACKGROUND OF THE INVENTION

Color photographic paper is used in a wide variety of photoprocessing machines, which include large-scale processors capable of providing large volumes of photographic prints under conditions of continuous operation, and small-scale processors that are used to produce smaller volumes of photographic prints under conditions of discontinuous operation. These machines are known to differ widely in mechanical design, and the operating conditions for these processors vary widely in ambient temperature and humidity due to the wide variety of environments for use.

To provide a color photographic paper that serves all the different machines and conditions and is tolerant of the wide fluctuations in environment, one must address the variation of color paper performance to changes in heat and humidity at the site of operation. One aspect of these variations relates to the sensitivity of the photographic paper to changes in temperature, otherwise known as heat sensitivity. It is desirable to make photographic materials that are invariant to any changes in environmental temperature, such that the photographic response does not change when the ambient temperature fluctuates during the course of processor operations. Alternatively, satisfactory results can be achieved when the photographic response is neutral with respect to changes in environmental temperature; that is, although the photographic material may have a different response as the temperature changes, the changes are not noticeable to the operator as the effects of temperature in each of the constituent layers are synchronized to annul the effect of the temperature changes. It is known that heat sensitivity of the photographic material is critical to its acceptability for use, and that changes in heat sensitivity can occur when changes are made in the process of manufacturing. Thus, it is highly desirable that manufacturing changes do not degrade heat sensitivity.

There has been considerable effort devoted to improving the sensitivity of silver halide crystals to actinic radiation and thereby increasing the sensitivity of the photographic elements in which they are contained. In this regard, photographic chemists have attempted to vary the components of, or the processes for making, silver halide emulsions. One particularly preferred means to improve sensitivity has been to chemically sensitize photographic emulsions with one or more compounds containing labile atoms of gold, sulfur, selenium, or the like. Examples of chemically sensitized photographic silver halide emulsion layers are described in, for example, *Research Disclosure*, Item No. 308119, December 1989, Section III, and the references listed therein. (*Research Disclosure* is published by Kenneth Mason Publications Ltd, Dudley Annex, 12a North Street, Emsworth, Hampshire PO10 7DQ, England.)

One common gold sensitizer used in the sensitization of silver halide emulsions is aurous sulfide, which is made as a colloidal gelatin dispersion, the exact composition of which is not well characterized. This gold sulfide dispersion can give rise to lot-to-lot variability and undesirable and inconsistent sensitometric performance. The source of this variability may come from side reactions in the preparation of this highly insoluble solid since these reactions produce species, which may be photographically active. Further, because of the highly insoluble nature of gold sulfide, most of the sensitizer added is, in fact, unused during the sensitization. The remaining sensitizer left in the gel/silver halide matrix can affect sensitometry.

Other organo gold compounds have been described; for example, U.S. Pat. No. 3,503,749 describes the use of water soluble Au(I) thiolate salts comprising one Au atom ligated to one sulfur containing ligand, and JP 8069075 discusses the use of organic gold sulfide compounds in the sensitization to give low fogging and high contrast silver halide photographic materials. U.S. Pat. No. 5,220,030 teaches the use of Au(I) compounds with bis mesoionic heterocycles; U.S. Pat. No. 5,252,455 and U.S. Pat. No. 5,391,727 disclose the use of Au(I) macrocyclic cationic sensitizers; and U.S. Pat. No. 5,049,484 teaches the use of Au(I) sensitizers having a Au atom ligated to the nitrogen atom of heterocyclic rings. These gold compounds, while being useful sensitizers, are somewhat lacking in solution stability. U.S. Pat. No. 5,945,270 describes the use of water soluble organomercapto Au(I) complex as being useful sensitizers in silver chloride emulsions.

Gold complexes containing the thiosulfonato group have been reported. U.S. Pat. No. 5,620,841 discloses the use of gelatin dispersions of a Au(I) thiosulfonato sensitizer with two different ligands, at least one of which is mesoionic. U.S. Pat. No. 5,700,631 teaches the use of gelatin dispersions of Au(I) thiosulfonato sensitizers with two different ligands, at least one of which is a thioether group. U.S. Pat. No. 5,939,245 teaches the sensitization of silver chloride emulsions by Au(I) thiosulfonato sensitizers the composition of which contains a thiourea moiety.

Regardless of the extensive activity in this area, there is a continuing need for Au(I) compounds that are effective sensitizers and that are stable, water soluble and well characterized. Further, such compounds must be easily manufacturable from readily available starting materials.

SUMMARY OF THE INVENTION

This invention relates to a photographic element comprising a support and a silver halide emulsion layer, the emulsion layer comprising a water soluble Au(I) complex having the formula $$[L—Au—L]_n^- M^{+n}$$

wherein the complex is symmetrical; L is an organothiosulfonato ligand, M is a cationic counter ion, and n is 1 to 4. This invention further relates to a silver halide photographic element comprising a support and a silver halide emulsion layer, the emulsion layer comprising an organothiosulfonato Au(I) complex having the formula $$[A—SO_2S—Au—SSO_2—A]_n^- M^{+n}$$

wherein M is a cationic counterion;

A is a substituted or unsubstituted organic group;

and n is 1 to 4; and wherein the compound is symmetrical.

This invention also provides a silver halide photographic element comprising a support and a silver halide emulsion layer, the emulsion layer having been chemically sensitized in the presence of an organothiosulfonato Au(I) complex having the above formula. It further provides a method of preparing a silver halide emulsion comprising precipitating silver halide grains in an aqueous colloidal medium to form an emulsion, heating the emulsion, and adding to the emulsion, either before or during heating, an organothiosulfonato Au(I) complex of the above formula.

The novel organothiosulfonato Au(I) complexes contained in the photographic elements of this invention have numerous advantages. They are highly effective sensitizers for silver halide emulsions. They are also water soluble. Because of the water solubility of these complexes, the use of costly and time-consuming preparation of gel dispersions is unnecessary. Further, there is no need to use large volumes of water for dissolving the complexes.

Unlike prior mixed-ligand gold compounds, the two Au ligands in the complexes of this invention are identical, thus reducing the complexity of preparation. Further, the complexes utilize commercially available starting materials. Another advantage is that the preparation of the gold complexes of the present invention does not utilize dangerous explosive gold fulminates or large quantities of organic solvents.

The organothiosulfonates used in the preparation of the Au(I) complexes may include the numerous thiosulfonate antifoggants/stabilizers. Because of the sensitizing, antifogging, and stabilizing properties of these thiosulfonate ligands, the Au(I) sensitizers derived from these ligands may also show speed enhancing and antifogging/stabilizing effects in addition to their sensitizing properties. The sensitizers may particularly have improved heat sensitivity over prior art sensitizers.

DETAILED DESCRIPTION OF THE INVENTION

The water soluble organothiosulfonate Au(I) complexes used in this invention may be represented by the formula $$[L—Au—L]_n^- M^{+n}$$

wherein the complex is symmetrical. L is an organothiosulfonato ligand which may have antifogging, stabilizing or sensitizing properties, and which is suitable for use in a silver halide photographic element. Many such ligands are known in the art and are either commercially available or may be prepared by the reaction of aromatic sulfonyl chloride with sodium hydrosulfide or from alkali arenesulfinates with elemental sulfur in liquid ammonia as described in *Synthesis* #8 p. 615 (1980). Thus, both benzenethiosulfonate and tolylthiosulfonate sodium salts are prepared. M is a cationic counter ion and n is 1 to 4.

The organothiosulfonato Au(I) complexes used in the invention may be further represented by the formula $$[A—SO_2S—Au—SSO_2—A]_n^- M^{+n}$$

with the complex being symmetrical around the atomic Au. M is a cationic counter ion. Preferably M is an alkali or alkali earth metal, for example lithium, sodium, potassium, rubidium, cesium, magnesium, calcium, strontium or barium, or an ammonium cation, for example, a tetrabutyl or tetraethyl ammonium group. M may also be, for example, $Fe^{+4}$ or $Mn^{+3}$. n is 1 to 4, preferably 1 or 2. A is a substituted or unsubstituted organic radical. Preferably A is an aliphatic, (cyclic or acyclic), aromatic or heterocyclic group. When A is an aliphatic group, preferably it is a substituted or unsubstituted aliphatic group having 1 to 20 carbon atoms, and more preferably having 1 to 8 carbon atoms. Examples of appropriate groups include alkyl groups such as methyl, ethyl, propyl, butyl, pentyl, hexyl, octyl, 2-ethylhexyl, decyl, dodecyl, hexadecyl, octadecyl, cyclohexyl, isopropyl and t-butyl groups.

The heterocyclic groups may be substituted or unsubstituted 3- to 15-membered rings with at least one atom selected from nitrogen, oxygen, sulfur, selenium, and tellurium in the ring nucleus. Examples of heterocyclic groups include the radicals of pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

The preferred aromatic groups have from 6 to 20 carbon atoms. More preferably, the aromatic groups have 6 to 10 carbon atoms and include, among others, phenyl and naphthyl groups. Preferably, the aromatic group is a phenyl ring.

These groups may have substituent groups. Unless otherwise specifically stated, substituent groups may include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentyiphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy. One particularly suitable substituent for A is a methyl group.

Specific examples of the Au(I) complexes include, but are not limited to (G)

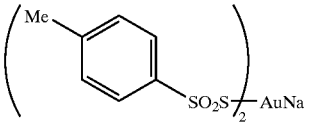

(H)

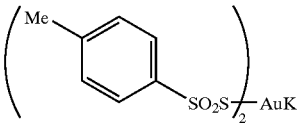

(I)

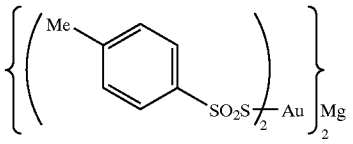

(J)

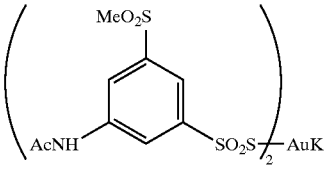

(K)

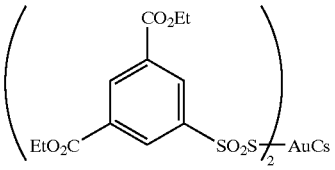

-continued (L)

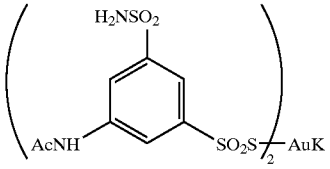

(M)

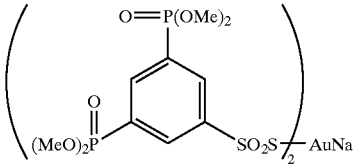

(N)

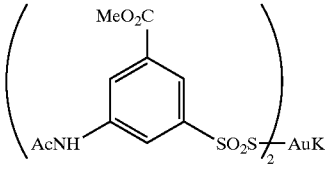

(O)

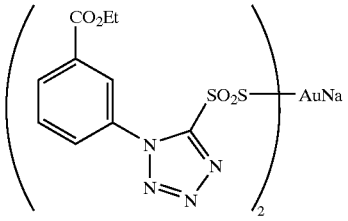

(P)

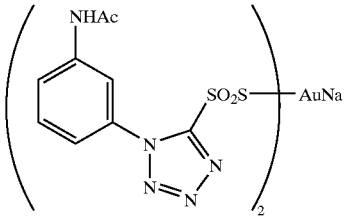

(Q)

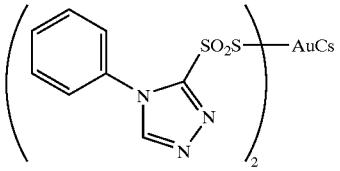

(R)

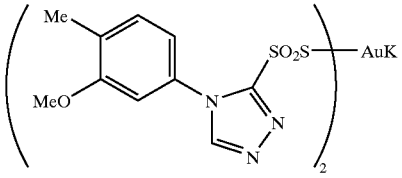

(S)

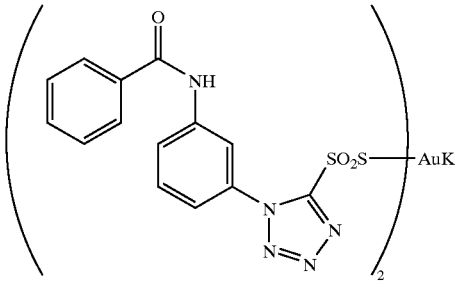

-continued (T)

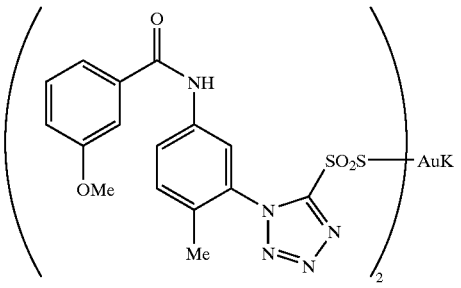

(U)

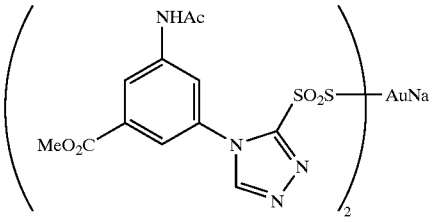

(V)

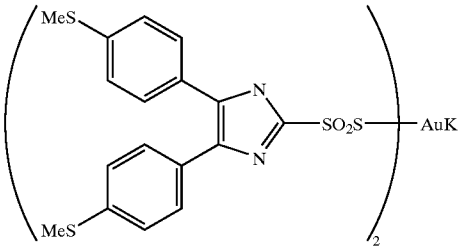

(W)

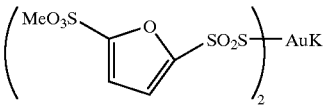

(X)

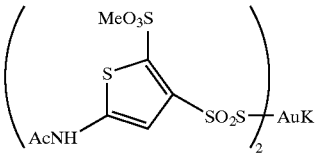

Y

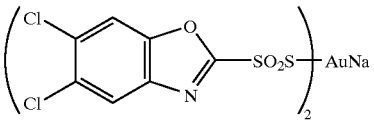

Z

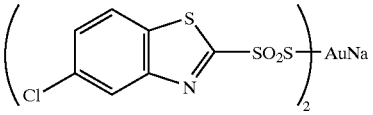

One particularly suitable complex is Compound G, sodium bis (4-methylphenylthiosulfonato) aurate(I).

One of the advantages of the complexes of this invention is their solubility in water. Preferably they have a solubility at 22° C. of 2 g/L, more preferably 5 g/L, and most preferably 10 g/L. Particularly suitable compounds have a solubility of greater than 20 g/L.

The organothiosulfonato Au(I) complexes preferably are manufactured by reacting a Au(I) complex with an organothiosulfonato ligand and isolating the resulting organothiosulfonato Au(I) complex from the reaction mixture. Suitable Au(I) complexes for use in this process are those having a more positive redox potential than the desired organothiosulfonato Au(I) complex, thus allowing for the easy replacement of the ligand. Such compounds are known to those skilled in the art. Examples of some useful Au(I) complexes include $AuCl_2^-$, $AuBr_2^-$, $Au(MeS—CH_2—CH_2—CHNH_2COOH)_2^+$, $Au(C_3H_3N_2—CH_2—CH_2—NH_2)_2^+$, $Au(CNS)_2^-$, AuCl, Au Br, AuI, or $Au(NH_3)_2^+$, with AuCl being particularly suitable. AuI is the least preferred of the above complexes.

Because the Au(I) complexes can be somewhat unstable, it is preferred to prepare them immediately before use by reacting a Au(III) compound with a stoichiometric amount of a reducing agent. The Au(III) compound can be any such compound which can be reduced to a stable Au(I) complex. Many of these compounds are commercially available. Examples of suitable compounds include $AuI_3$, $KAuBr_4$, $KAuCl_4$, $AuCl_3$ and $HAuCl_4$. The reducing reagents may be, among others, tetrahydrothiophene, 2,2'-thiodiethanol, thiourea, N,N'-tetramethylthiourea, alkyl sulfides (eg. dimethylsulfide, diethylsulfide, diisopropylsulfide), thiomorpholin-3-one, sulfite, hydrogen sulfite, uridine, uracil, alkali hydrides, alkyl alcohols and iodide. (Uson, R.; Laguna, A.; Laguna, M. *Inorg. Synth.* 1989, 26, 85–91; Al-Saady, A. K.; McAuliffe, C. A.; Parish, R. V.; Sandbank, J. A. *Inorg. Synth.* 1985, 23, 191–194; Ericson, A.; Elding, L. I.; Elmroth, S. K. C.; *J. Chem. Soc., Dalton Trans.* 1997, 7, 1159–1164; Elding, L. I.; Olsson, L. F. *Inorg. Chem.* 1982, 21, 779–784; Annibale, G.; Canovese, L.; Cattalini, L.; Natile, G. *J. Chem. Soc., Dalton Trans.* 1980, 7, 1017–1021). In some instances the reduction can be performed in the presence of a stabilizing agent such as the chloride anion (Miller, J. B.; Burmeister, J. L. *Synth. React. Inorg. Met.—Org. Chem.* 1985, 15, 223–233). In some instances it may be desirable to isolate the resulting Au (I) compound, i.e. to avoid undesirable side reactions. For example, in the case of AuI, removal of excess iodine is desirable to avoid deleterious sensitometric effects. Depending on the stability of the resulting Au(I) compound, however, its isolation may not be practical.

It is preferable that the Au(I) complex/organothiosulfonato reaction be completed in an aqueous system, however, this is not imperative. In general, the procedure requires no more than the mixing or stirring of the reagents for a short time, preferably at a temperature slightly above room temperature. In one preferred embodiment the Au(I) compound is treated with at least two equivalents of a water soluble organo thiosulfonato ligand, preferably a water soluble salt of the ligand. Only one species of organothiosulfonato ligand is utilized in the reaction in order to obtain a symmetrical thiosulfonato Au(I) complex. Preferably the organothiosulfonato ligand has the formula $$(A—SO_2S)^-_nM^{+n}$$

wherein M, A and n are as defined earlier for the organothiosulfonato Au(I) complex. Preferably M of the organothiosulfonato ligand is sodium or magnesium, with magnesium being most preferred. One suitable organothiosulfonate ligand is 4-methylphenylthiosulfonate potassium salt (AA). Another organothiosulfonate ligand is 4-methylphenylthiosulfonate magnesium salt (BB).

In another embodiment the Au(III) complex may be reacted directly with an excess of the above described organothiosulfato ligand. In this embodiment the organothiosulfato ligand is also acting as the reducing agent. Examples of preferred Au(III) complexes include $HAuCl_4$, $NaAuCl_4$, or $AuCl_3$. Again it is preferred that the reaction be completed in an aqueous system.

The reactions may be done in a very broad temperature range, preferably ambient to 100° C., and more preferably 30 to 50° C. Generally, the reactions can take place in the natural pH of the system, and do not need adjustment. It is believed that a fairly neutral pH, of about 4 to 7.5 is preferable, with a pH of about 6 being most preferable. In most cases the reaction of the Au(I) complex or the Au(III) complex and the organothiosulfonato ligand takes place in just a few minutes at a temperature of 30° C., although this may differ depending on the reactants. It may be necessary to add a stabilizing electrolyte such as $Cl^-$ or $Br^-$ when utilizing particularly unstable Au(I) complexes.

Isolation of the resulting Au(I) product may be achieved by any suitable method, for example by the treatment of the reaction mixture with several equivalents of an alkali or alkaline earth metal halide or by the addition of a non-solvent. The solid Au(I) complex may be collected by filtration and dried in vacuo. The preferred method of isolation typically involves the introduction of an alkali or alkaline earth metal halide followed by cooling of the reaction solution. The material is isolated by suction filtration. The procedure is straight forward with no complicated operations The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The organothiosulfonato Au(I) complexes may be added to the silver halide emulsion at any time during the preparation of the emulsion, i.e., during precipitation, during or before chemical sensitization or during final melting and co-mixing of the emulsion and additives for coating. Preferably, the emulsion is chemically sensitized in the presence of the organothiosulfonato Au(I) complexes. More preferably, these compounds are added after precipitation of the grains, and most preferably they are added before or during the heat treatment of the chemical sensitization step.

The organothiosulfonato Au(I) complexes may be introduced into the emulsion at the appropriate time by any of the various techniques known to those skilled in the art. Preferably they are added as an aqueous solution to the emulsion. One suitable method includes preparing a silver halide emulsion by precipitating silver halide grains in an aqueous colloidal medium to form an emulsion, digesting (heating) the emulsion, preferably at a temperature in the range of 40 to 80° C., and adding to the emulsion, either before or during heating, an aqueous solution of the organothiosulfonato Au(I) complex. In one preferred embodiment the emulsion is also sensitized with thiosulfate pentahydrate (hypo).

Conditions for sensitizing silver halide grains such a pH, pAg, and temperature are not particularly limited. The pH is generally about 1 to 9, preferably about 3 to 6, and pAg is generally about 5 to 12, preferably from about 7 to 10.

The organothiosulfonato Au(I) complexes may also be added to the vessel containing the aqueous gelatin salt solution before the start of the precipitation; or to a salt solution during precipitation. Other modes are also contemplated. Temperature, stirring, addition rates, and other precipitation factors may be set within conventional ranges, by means known in the art, so as to obtain the desired physical characteristics.

The organothiosulfonato Au(I) complexes may be used in addition to any conventional sensitizers as commonly practiced in the art. Combinations of more than one organothiosulfonato Au(I) complex may be utilized.

Useful levels of Au(I) sensitizers of the present invention may range from 0.01 $\mu$mol to 10,000 $\mu$mol per silver mole. The preferred range is from 0.05 $\mu$mol to 1,000 $\mu$mol per silver mole. A more preferred range is from 0.1 $\mu$mol to 500 $\mu$mol per silver mole. The most preferred range is from 1 $\mu$mol to 50 $\mu$mol/Ag mole.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferably, the silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic emulsions may be incorporated into color negative (particularly color paper) or reversal photographic elements. The photographic element may also comprise a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 micrometers. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. High chloride photographic elements and methods of processing such elements particularly suitable for use with this invention are described in *Research Disclosure*, February 1995, Item 37038, in *Research Disclosure*, September 1997, Item 40145 and, of particular interest, *Research Disclosure*, September 2000, Item 437013 published by Kenneth Mason Publications, Ltd., Dudley Annex, 12a North Street, Emsworth, Hampshire PO10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 & 4 | I, II, III, IX A & B | including hardeners, coating aids, addenda; etc. |
| 1 | III, IV | Chemical sensitization and |
| 2 | III, IV | spectral sensitization/ |
| 3 & 4 | W, V | desensitization |
| 1 | V | UV dyes, optical brighteners, |
| 2 | V | luminescent dyes |
| 3 & 4 | VI | |
| 1 | VI | |
| 2 | VI | Antifoggants and stabilizers |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Wash-out |
| 3 & 4 | X | couplers; Dye stabilizers and hue modifiers |
| 1 | XVII | |
| 2 | XVII | Supports |
| 3 & 4 | XV | |
| 3 & 4 | XI | Specific layer arrangements |
| 3 & 4 | XII, X11I | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements may utilize any traditional support known to those skilled in the art. One conventional photographic quality paper comprises cellulose paper with polyethylene resin waterproof coatings. The support may also consist of a multilayer film of biaxially oriented polyolefin which is attached to both the top and bottom of a photographic quality paper support by melt extrusion of a polymer tie layer. The biaxially oriented films may contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final image. These supports are described in more detail in U.S. Pat. Nos. 5,866,282; 5,888,681; 6,030,742; 6,030,759; 6,107,014; and 6,153,351. Such biaxially oriented films may also be utilized for display materials having translucent or transparent supports.

The photographic elements comprising the radiation sensitive high chloride emulsion layers can be conventionally optically printed, or can be image-wise exposed in a pixel-by-pixel mode using suitable high energy radiation sources typically employed in electronic printing methods. Suitable actinic forms of energy encompass the ultraviolet, visible, and infrared regions of the electromagnetic spectrum, as well as electron-beam radiation and is conveniently supplied by beams from one or more light emitting diodes or lasers, including gaseous or solid state lasers. Exposures can be monochromatic, orthochromatic, or panchromatic. For example, when the recording element is a multilayer multicolor element, exposure can be provided by laser or light emitting diode beams of appropriate spectral radiation, for example, infrared, red, green, or blue wavelengths, to which such element is sensitive. Multicolor elements can be employed which produce cyan, magenta, and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated, or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18, and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$, and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al, *A Continuous-Tone Laser Color Printer*, Journal of Imaging Technology, Vol. 14, No. 3, June 1988, which is hereby incorporated herein by reference. A description of some of the details of conventional electronic printing methods comprising scanning a recording element with high energy beams, such as light emitting diodes or laser beams, are set forth in Hioki U.S. Pat. No. 5,126,235, European Patent Applications 479 167 A1 and 502 508 A1.

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

Processing to form a visible dye image includes the step of contacting the element with a color developing agent to reduce developable silver halide and oxidize the color developing agent. Oxidized color developing agent in turn reacts with the coupler to yield a dye. With negative-working silver halide, the processing step described above provides a negative image. In one embodiment the described elements can be processed in the known color print processes such as the RA-4 process of Eastman Kodak Company, Rochester, N.Y.

The following examples are intended to illustrate, but not limit, the invention.

EXAMPLES

Example 1

Preparation of Compound (I).

eq. 1

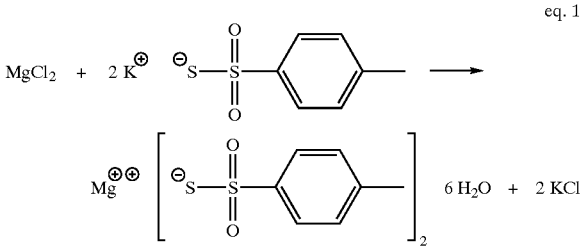

Synthesis of (BB) according to equation 1. To 100 mL of ethanol in an Erlenmeyer flask was added 4.8 g of $MgCl_2$. The mixture was stirred until a solution resulted. The $MgCl_2$ solution was then added to a suspension of 22.6 g of (AA) in 200 mL of ethanol. The mixture was stirred for 30 minutes at 55 C. and then allowed to cool to ambient temperature. The suspension was filtered to remove the resulting potassium chloride precipitate and the filtrate evaporated so that ca. 10 mL of a colorless solution remained. Finally, 200 mL of diethyl ether followed by 10 mL of acetone were added to the solution causing the immediate formation of a white solid. The solid was collected on a medium glass fritted funnel and dried in vacuo for four hours. The isolated yield was 21.2 g (84%). The isolated product's identity was confirmed by $^1H$ NMR spectroscopy, electrospray mass spectral analysis and microanalysis: $^1H$ NMR ($D_2O$) δ 2.38 ppm (s, 3H), δ 7.35 ppm (d 8 Hz, 2H), δ 7.81 ppm (d 8 Hz, 2H); Electrospray MS (negative ion mode) M/Z=187, ($TSS^-$). Anal. Calc. For $C_{14}H_{26}MgO_{10}S_4$: C 33.17%, H 5.17%, S 25.30%; Found: C 33.12%, H 4.88%, S 25.39%.

$$Mg(TSS)_2+AuCl \rightarrow 0.5MgCl_2+0.5Mg[Au(TSS)_2]_2 \quad \text{eq 2}$$

The complex (I) was synthesized according to equation 2 by dissolving 3.78 g of (BB) in 5 mL of high purity water and filtering the mixture through a medium porosity glass fritted funnel. To the solution of (BB) was added 1.5 g of AuCl obtained from a commercial source. The resulting suspension was stirred rapidly for 5 minutes at 30 C. The suspension was filtered through 0.45μ glass membrane filter, and the resulting colorless solution was treated with 12.5 mL of a 5.1 M aqueous magnesium chloride solution. The reaction mixture was cooled for 1 hour in an ice bath. The solution above the resulting gummy oil was decanted and discarded. The gummy solid was extracted with acetone (2×20 mL), filtered through a 0.2μ Teflon membrane filter followed by solvent removal in vacuo. The resulting oil was treated with ca. 100 mL of methylene chloride, which immediately yielded a gelatinous solid. The solid was warmed under vacuum until 2.44 g (57%) of an off-white solid was isolated. Compound I displays $^1H$ NMR and mass spectra consistent with a material possessing the molecular structure illustrated above. $^1H$ NMR (dmso-$d_6$) δ 2.35 ppm (s, 3H), δ 7.28 ppm (d 8 Hz, 2H), δ 7.77 ppm (d 8 Hz, 2H); Electrospray MS (negative ion mode) M/Z=571 ($[Au(TSS)_2]^-$); Thermogravimetric analysis (TGA) and microanalysis confirm the presence of ca. 9 equivalents of water: TGA: ambient temperature to 150 C., 10.56% weight loss~9 equivalents of $H_2O/Mg[Au(TSS)_2]_2$; Anal. Calc. For $C_{28}H_{46}Au_2MgO_{17}S_8$: C 25.3%, H 3.5%, S 19.3%; Found: C 25.17%, H 3.19%, S 19.10%.

Example 2

Preparation of (G)

$$Mg(TSS)_2+AuCl+NaCl \rightarrow MgCl_2+Na[Au(TSS)_2] \quad \text{eq 3}$$

The complex (G) was synthesized by dissolving 3.78 g of (BB) in 5 mL of high purity water and filtering the mixture through a medium porosity glass fritted funnel. To the solution of(BB) was added 1.5 g of AuCl. The resulting suspension was stirred rapidly for 5 minutes at 30 C. The suspension was filtered through 0.45μ glass membrane filter and the resulting colorless solution treated with 5 mL of a saturated sodium chloride solution. Initially an oil formed which was crystallized after rapid stirring. The white solid was collected on a glass funnel and air-dried overnight. The isolated yield was 3.47 g (91%). The crude product was purified by dissolving 1 g of the solid in 20 mL of acetone. The solution was filtered through 0.2μ Teflon membrane filter and the acetone solvent was removed in vacuo. The resulting oil was dissolved in 20 mL of methylene chloride and the solvent was removed in vacuo. The process was repeated again and the resulting solid was collected on a glass flitted funnel and air-dried. The isolated yield was 0.75 g (75%). Compound G displays $^1H$ NMR and mass spectra and microanalyses consistent with a material possessing the molecular structure shown above: $^1H$ NMR ($D_2O$) δ 2.00 ppm (s, 3H), δ 6.94 ppm (d 8 Hz, 2H), δ 7.58 ppm (d 8 Hz, 2H); Electrospray MS (negative ion mode) M/Z=571 ($[Au(TSS)_2]^-$); Anal. Calc. For $C_{14}H_{14}NaO_4S_4$: C 28.3%, H 2.4%, S 21.6%; Found: C 28.80%, H 2.48%, S 21.56%.

Example 3

Preparation of Compound (H)

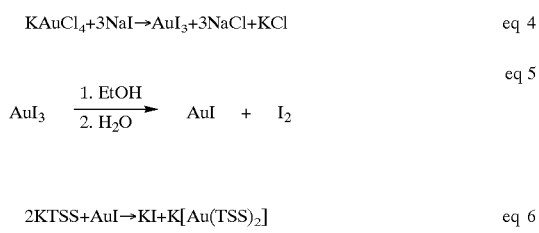

$$KAuCl_4+3NaI \rightarrow AuI_3+3NaCl+KCl \quad \text{eq 4}$$

$$AuI_3 \xrightarrow[2.\ H_2O]{1.\ EtOH} AuI + I_2 \quad \text{eq 5}$$

$$2KTSS+AuI \rightarrow KI+K[Au(TSS)_2] \quad \text{eq 6}$$

In an Erlenmeyer flask, 5.0 g of $KAuCl_4$ was dissolved in 50 mL of high purity water and treated with 50 mL of high purity water containing 6.3 g of sodium iodide. The supernatant was discarded and the resulting insoluble $AuI_3$ was washed four times with 100 mL of high purity water. After the last water wash was decanted, the $AuI_3$ was washed nine times with 100 mL of ethanol. The resulting lemon yellow AuI solid was washed twice with 100 mL of high purity water yielding a lemon yellow solid in a minimum of high purity water after a final decantation. To 150 mL of high purity water was added 4.0 g of (AA). The resulting mixture was filtered to remove adventitious sulfur and transferred to a 500 mL beaker. The aqueous (AA) solution was heated to 40 C. and then treated with the AuI suspension prepared previously. The yellow color of the suspension was transformed to creamy white as the reaction progressed. Filtration of the suspension on a glass fritted funnel followed by drying in vacuo yielded the desired product in quantitative yield (7.6 g). The complex was recrystallized by extraction with acetone followed by precipitation by the addition of water. $^1H$ NMR (dmso-$d_6$) δ 2.36 ppm (s, 3H), δ 7.29 ppm (d 8 Hz, 2H), δ 7.79 ppm (d 8 Hz, 2H); Electrospray MS (negative ion mode) M/Z=571 ($[Au(TSS)_2]^-$); Anal. Calc. For $C_{14}H_{14}KO_4S_4$: C 27.5%, H 2.3%, S 21.0%; Found: C 27.49%, H 2.34%, S 21.13%.

Example 4

Alternative Preparation of Compound (I)

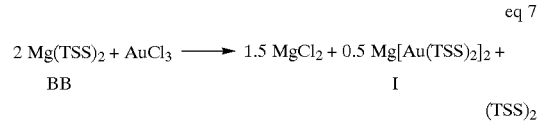

$$\underset{BB}{2\ Mg(TSS)_2} + AuCl_3 \longrightarrow 1.5\ MgCl_2 + 0.5\ \underset{I}{Mg[Au(TSS)_2]_2} + (TSS)_2 \quad \text{eq 7}$$

Although it is preferable to react an Au(I) complex with the organothiosulfonato ligand, it is also possible to utilize an Au(III) complex according to eq 7. The complex (I) was synthesized according to eq 7 by mixing 3.34 g of (BB) in 25 mL of absolute ethanol with 1 g of $AuCl_3$ in 25 mL of absolute ethanol. The reaction solution was analyzed by electrospray mass spectrometry which displayed a mass spectrum consistent with a material possessing the molecular structure illustrated above. Electrospray MS (negative ion mode) M/Z=571 ($[Au(TSS)_2]^-$).

Example 5

In accordance with the present invention, a 0.3 mole cubic negative silver chloride emulsion was sensitized with p-glutaramidophenyl disulfide (10 mg/Ag mol), hypo (7.42 mg/Ag mol), and gold sensitizers indicated in Table 1 at 40° C. The emulsion was heated to 64.4° C. at a rate of 20° C. per 17 minutes and then held at this temperature for 52 minutes. During this time 1-(3-acetamidophenyl)-5-mercaptotetrazole (297 mg/Ag mol), potassium hexachloroiridate (0.121 mg/Ag mol), and potassium bromide (1359 mg/Ag mol) were added. The emulsion was cooled down to 40° C. at a rate of 20° C. per 17 minutes. At this time, a red spectral sensitizing dye, D-3 (12 mg/Ag mol), was added and the pH of the emulsion adjusted to 6.0. An emulsion thus sensitized also contained the cyan dye-forming coupler CC-1 in di-n-butyl phthalate coupler solvent (0.429 g/$m^2$) and gelatin (1.08 g/$m^2$). The emulsion (0.18 g Ag/$m^2$) was coated on a resin coated paper support and 1.076 g/$m^2$ gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tungsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The speed taken at the 1.0 density point of the D log E curve is taken as a measure of the sensitivity of the emulsion. Dmin is measured as the minimum density above zero. Changes in fog density of the coatings after a four week storage at 120° F. relative to those kept at 0° F. is recorded as ΔDmin.

TABLE 1

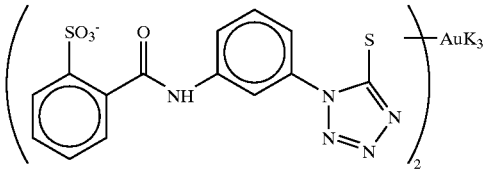

CS

| Sample | Au | Au μmol/ Ag mol | Fresh Speed | Fresh Dmin | 4 week 120 vs 0 ΔDmin |
|---|---|---|---|---|---|
| 1 (comparison) | CS | 16.40 | 0.706 | 0.086 | 0.009 |
| 2 (comparison) | CS | 19.29 | 0.694 | 0.083 | 0.010 |
| 3 (comparison) | CS | 22.18 | 0.688 | 0.084 | 0.011 |
| 4 (invention) | H | 16.40 | 0.751 | 0.086 | 0.010 |
| 5 (invention) | H | 19.29 | 0.750 | 0.083 | 0.010 |
| 6 (invention) | H | 22.18 | 0.736 | 0.087 | 0.011 |
| 7 (invention) | G | 16.40 | 0.739 | 0.086 | 0.007 |
| 8 (invention) | G | 19.29 | 0.747 | 0.084 | 0.010 |
| 9 (invention) | G | 22.18 | 0.738 | 0.087 | 0.011 |
| 10 (invention) | I | 16.40 | 0.723 | 0.086 | 0.008 |
| 11 (invention) | I | 19.29 | 0.750 | 0.083 | 0.009 |
| 12 (invention) | I | 22.18 | 0.738 | 0.086 | 0.011 |

It can be seen in Table 1 that samples 1, 2 and, 3, sensitized with the conventional sensitizer (CS), all have lower speed than samples of the present invention (4–12) which contain Au(I) sensitizers G, H, and I. Specifically, the inventive samples show higher speed without any detrimental increase in fog either in the fresh samples or in samples that have been subjected to the accelerated keeping conditions.

Example 6

In another practice of the invention, the same negative silver chloride emulsion was sensitized as in Example 5, except the Au(I) sensitizers and their levels are those listed in Table (2). In addition, compound (AA) was added to samples 14 and 20 through 24. The emulsions were then prepared, coated, and exposed as those in Example 5.

TABLE 2

| Sample | Au | μmol/ Ag mol Au | μmol/ Ag mol AA | Fresh Speed | Fresh Dmin | 4 week 120 vs 0 Δ Dmin |
|---|---|---|---|---|---|---|
| 13 (comparison) | None | 0 | 0 | 0.118 | 0.091 | 0.01 |
| 14 (comparison) | None | 00.00 | 34.72 | 0.154 | 0.093 | 0.011 |
| 15 (comparison) | CS | 17.36 | 00.00 | 0.624 | 0.09 | 0.023 |
| 16 (comparison) | CS | 19.29 | 00.00 | 0.625 | 0.09 | 0.023 |
| 17 (comparison) | CS | 21.20 | 00.00 | 0.629 | 0.087 | 0.025 |
| 18 (comparison) | CS | 22.18 | 00.00 | 0.62 | 0.091 | 0.02 |
| 19 (comparison) | CS | 23.15 | 00.00 | 0.643 | 0.092 | 0.023 |
| 20 (comparison) | CS | 17.36 | 34.72 | 0.64 | 0.085 | 0.022 |
| 21 (comparison) | CS | 19.29 | 38.58 | 0.618 | 0.087 | 0.023 |
| 22 (comparison) | CS | 21.20 | 44.36 | 0.599 | 0.088 | 0.027 |
| 23 (comparison) | CS | 22.18 | 44.36 | 0.587 | 0.09 | 0.023 |
| 24 (comparison) | CS | 23.15 | 46.3 | 0.592 | 0.089 | 0.028 |
| 25 (invention) | G | 17.36 | 00.00 | 0.656 | 0.092 | 0.022 |
| 26 (invention) | G | 19.29 | 00.00 | 0.676 | 0.088 | 0.02 |
| 27 (invention) | G | 21.20 | 00.00 | 0.665 | 0.087 | 0.018 |
| 28 (invention) | G | 22.18 | 00.00 | 0.655 | 0.089 | 0.018 |
| 29 (invention) | G | 23.15 | 00.00 | 0.681 | 0.09 | 0.023 |

It can be seen in Table 2 that samples 13 (sensitized only with hypo, but without an Au sensitizer) and 14 (as in sample 13 except compound AA was added) have hardly any sensitivity at all. That is to say, the ligand AA by itself contributes no additional sensitivity to the emulsion. Emulsion coatings (samples 15–19) sensitized with the art-known sensitizer have lower speed than samples of the present invention (25–29), which contain compound G. Furthermore, the speed advantage from the inventive sensitizers cannot be attained by combining CS with two equivalences of the ligand AA (samples 20–24). More importantly, the speed advantage of the inventive compound, G is not accompanied by incubation fog as shown after four weeks of accelerated keeping.

Example 7

In another practice of the invention, a 0.3 mol of a negative silver chloride emulsion was sensitized with with p-glutaramidophenyl disulfide (2.04 mg/Ag mol), 1.08 mg/Ag mol of sodium thiosulfate pentahydrate (hypo), the comparison sensitizer CS, and the inventive compound G at levels indicated in Table 3 at 40° C. The emulsion was heated to 65° C. at a rate of 10° C. per 6 minutes and then held at this temperature for 63 minutes. During this time, a green spectral sensitizing dye, D-2 (426.7 mg/Ag mol), a gelatin dispersion of a Lippmann bromide (795 mg/Ag mol) and a solution of 1-(3-acetamidophenyl)-5-mercaptotetrazole (96.14 mg/Ag mol) were added to the emulsion. The emulsion was cooled to 40° C. at a rate of 10° C. per 6 minutes. This emulsion was mixed further with a green dye-forming coupler MC-1 (0.018 g/m$^2$) in di-n-butylphthalate coupler solvent and gelatin. The emulsion (0.102 g Ag/m$^2$) was coated on a resin coated paper support and an overcoat applied as a protective layer along with the hardener bis (vinylsulfonyl) methyl ether in an amount of 1.8% of the total gelatin weight. These coatings were exposed and processed as for Example 5.

TABLE 3

| Sample | Au | μmol/ Ag mol | Speed | Dmin | 4 week 120 vs 0 Δ Dmin |
|---|---|---|---|---|---|
| 30 (comparison) | CS | 2.820 | 0.521 | 0.082 | 0.034 |
| 31 (comparison) | CS | 3.134 | 0.772 | 0.085 | 0.045 |
| 32 (comparison) | cS | 3.447 | 0.712 | 0.08 | 0.058 |
| 33 (comparison) | CS | 3.604 | 0.694 | 0.082 | 0.05 |
| 34 (comparison) | CS | 3.604 | 0.780 | 0.079 | 0.055 |
| 35 (comparison) | CS | 3.761 | 0.628 | 0.08 | 0.05 |
| 36 (invention) | G | 2.820 | 0.756 | 0.081 | 0.035 |
| 37 (invention) | G | 3.134 | 0.752 | 0.079 | 0.039 |
| 38 (invention) | G | 3.447 | 0.754 | 0.083 | 0.042 |
| 39 (invention) | G | 3.604 | 0.753 | 0.076 | 0.047 |
| 40 (invention) | G | 3.604 | 0.755 | 0.078 | 0.034 |
| 41 (invention) | G | 3.761 | 0.753 | 0.08 | 0.044 |

Data in Table 3 show that samples (30–35) containing the art-known sensitizer CS exhibit variable speeds for levels ranging form 2.82 to 3.761 μmol per silver mol. For replicate coatings (sample 33, 34) with 3.604 μmol per silver mol, there is a significant variability in the speed performance. For samples containing the inventive sensitizer, the coatings show hardly any variability. This is specially attractive in manufacturing where robustness is of major concern. The accelerated keeping data showed for the inventive samples that there is consistently smaller fog increase than the samples coated with the art-known sensitizer.

Example 8

Preparation of blue sensitive emulsion (Blue EM). A high chloride silver halide emulsion was precipitated by adding approximately equimolar amounts of silver nitrate and sodium chloride solutions into a reactor vessel containing a gelatin peptizer, p-glutaramidophenyl disulfide, and a thioether ripener. Cesium pentachloronitrosyl osmate(III) dopant was added during the silver halide grain formation for most of the precipitation followed by addition of potassium hexacyano ruthenate(II), potassium pentachloro-5-methylthiazole iridate(III), a small amount of KI solution, and then shelling to complete the precipitation. The resulting emulsion contained cubic shaped grains of 0.64 μm in edge length size. The emulsion was optimally sensitized in the presence of p-glutaramidophenyl disulfide, a colloidal suspension of aurous sulfide followed by a heat ramp, addition of blue sensitizing dye, D-1, 1-(3-acetamidophenyl)-5-mercaptotetrazole, an optimal amount of Lippmann bromide, and potassium hexachloro iridate(IV).

Preparation of green sensitive emulsion (Green EM). A high chloride silver halide emulsion was precipitated by adding approximately equimolar amounts of silver nitrate and sodium chloride solutions into a reactor vessel containing a gelatin peptizer and a thioether ripener. Cesium pentachloronitrosyl osmate(II) dopant was added during the silver halide grain formation for most of the precipitation, followed by potassium pentachloro-5-methylthiazole iridate (III), then shelling without further dopant. The resulting emulsion contained cubic shaped grains of 0.34 μm in edge length size. The emulsion was optimally sensitized in the presence of p-glutaramidophenyl disulfide, a colloidal suspension of aurous sulfide followed by a heat ramp, addition of green sensitizing dye, D-2, an optimal amount of 1-(3-acetamidophenyl)-5-mercaptotetrazole, and Lippmann bromide.

Preparation of red sensitive emulsion (Red EM). A high chloride silver halide emulsion was precipitated by adding approximately equimolar amounts of silver nitrate and sodium chloride solutions into a reactor vessel containing a gelatin peptizer and a thioether ripener. Most of the silver halide grain was precipitated without any dopant, followed by addition of potassium hexacyano ruthenate(II), potassium pentachloro-5-methylthiazole iridate(III), and further shelling. The resulting emulsion contained cubic shaped grains of 0.38 μm in edge length size. The emulsion was optimally sensitized with sensitizer G or CS as in Example 5

The emulsions were combined with dispersions using techniques known in the art. The resulting light-sensitive silver halide components were applied to polyethylene resin coated paper support as described in the coating format to provide samples 42–43.

TABLE 4

| COATING FORMAT | |
|---|---|
| | g/m$^2$ |
| Layer 1 | |
| Gelatin | 1.252 |
| Silver (Blue EM F) | 0.239 |
| YC-1 | 0.416 |
| ST-1 | 0.173 |
| ST-2 | 0.025 |
| ST-3 | 0.099 |
| S-1 | 0.219 |
| HQ-1 | 0.005 |
| H-1 | 0.147 |
| Layer 2 | |
| Gelatin | 0.756 |
| HQ-2 | 0.108 |
| S-2 | 0.198 |
| SQ-1 | 0.032 |
| Layer 3 | |
| Gelatin | 1.264 |
| Silver (Green EM) | 0.101 |
| MC-1 | 0.208 |
| S-2 | 0.112 |
| S-3 | 0.218 |
| ST-3 | 0.040 |
| ST-4 | 0.274 |
| Layer 4 | |
| Gelatin | 0.756 |
| HQ-2 | 0.108 |
| S-2 | 0.198 |
| SQ-1 | 0.032 |
| AWna | 0.057 |
| Layer 5 | |
| Gelatin | 1.326 |
| Silver (Red EM) | 0.202 |
| CC-1 | 0.233 |
| Di-n-butyl sebacate | 0.437 |
| Tris(2-ethylhexyl)phosphate | 0.146 |
| UV-1 | 0.356 |
| Tolylthiosulfonate potassium salt | 0.002 |
| Tolylsulfinate potassium salt | 0.0003 |

TABLE 4-continued
| COATING FORMAT | |
|---|---|
| | g/m$^2$ |
| Layer 6 | |
| Gelatin | 0.826 |
| UV-1 | 0.204 |
| UV-2 | 0.036 |
| HQ-2 | 0.066 |
| Tris(2-ethylhexyl)phosphate | 0.080 |
| Layer 7 | |
| Gelatin | 0.648 |
| DC-200 | 0.021 |
| Ludox AM | 0.162 |
| Support Polyethylene laminated paper | |
STRUCTURES
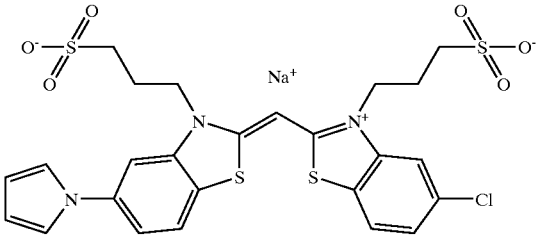
D-1
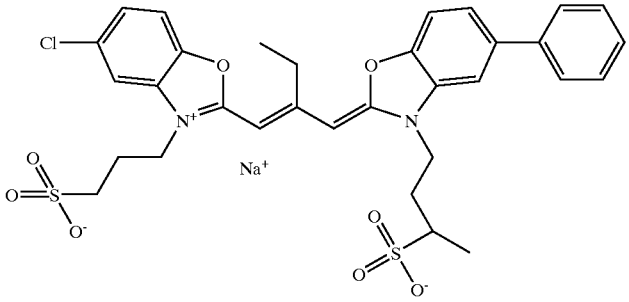
D-2
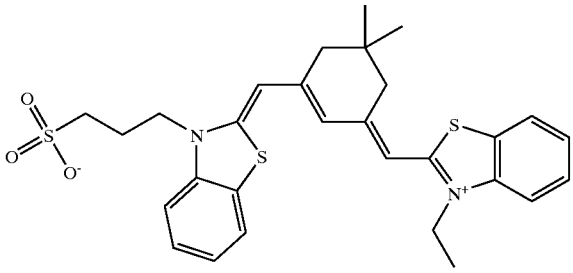
D-3

TABLE 4-continued
| COATING FORMAT | |
|---|---|
| | g/m$^2$ |
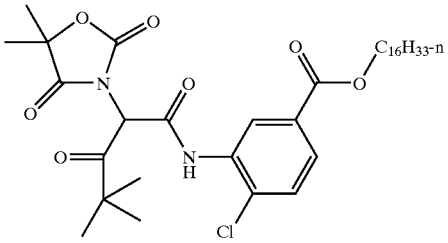
YC-1
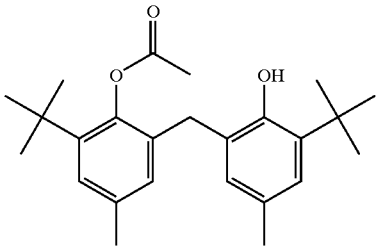
ST-1
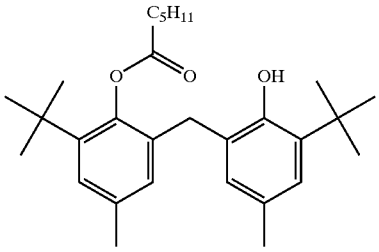
ST-2
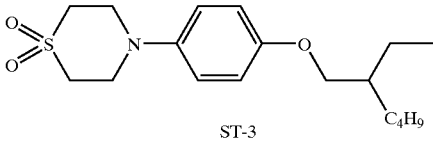
ST-3
| | |
|---|---|
| t-Butyl citrate | S-1 |
| 2,5-Dihydroxy-4-(1-methylheptadecyl)-benzenesulphonic acid (K salt) | HQ-1 |
| Bis(vinylsulphonyl)methane | H-1 |
| HQ-2 | |
| Diundecyl phthalate | S-2 |
| 4,5-Dihydroxy-1,3-benzenedisulfonic acid (disodium salt) | SQ-1 |
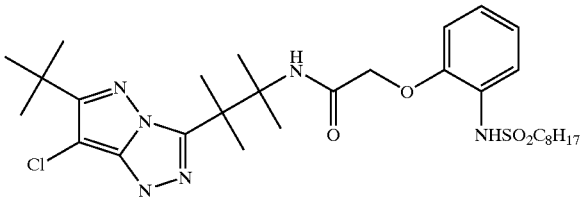
MC-1

TABLE 4-continued
| COATING FORMAT | |
|---|---|
| | g/m$^2$ |
| 9-Octadecen-1-ol | S-3 |
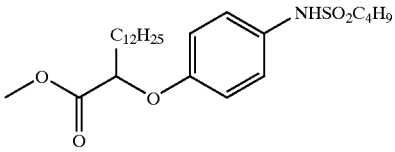
ST-4
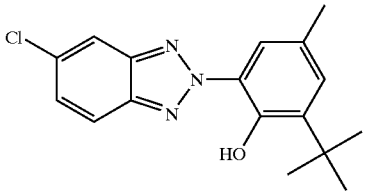
$AW_{na}$ copolymer
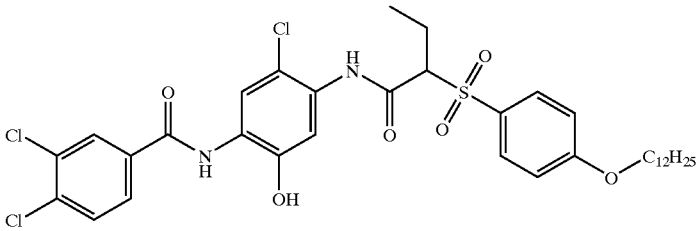
CC-1
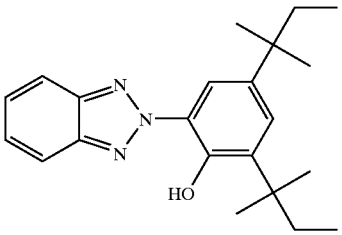
UV-1
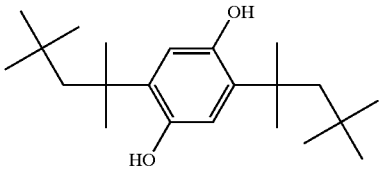
UV-2

The coatings are exposed and processed as in Example 6. Results of this experiment (Table 5) indicate that sample 43 of the current invention has a higher speed than sample 42 which is sensitized with the art-known Au(I) sensitizer. It can also be seen that sample 43 has more effective heat sensitivity reduction of the AgCl emulsions at either one of the exposure times.

TABLE 5

| | | | | Heat Sensitivity Speed | |
|---|---|---|---|---|---|
| Sample | Au | Speed | Stain | 0.032 s | 0.30 s |
| 42 (comparison) | CS | 0.057 | 0.095 | 0.055 | 0.051 |
| 43 (invention) | G | 0.109 | 0.098 | 0.046 | 0.043 |

The invention has been described in detail with particular reference to certain preferred embodiments thereof, but it will be understood that variations and modifications can be effected within the spirit and scope of the invention.

What is claimed is:

1. A photographic element comprising a support and a silver halide emulsion layer, the emulsion layer comprising a water soluble Au(I) complex having the formula $$[L—Au—L]_n^- M^{+n}$$

wherein the complex is symmetrical around the atomic Au; L is an organothiosulfonato ligand which has antifogging, stabilizing, or sensitizing properties, n is 1 to 4, and M is a cationic counterion.

2. The photographic element of claim 1 wherein A is a substituted or unsubstituted aliphatic, aromatic, or heterocyclic group.

3. The photographic element of claim 2 wherein A is a substituted or unsubstituted aliphatic group having 1 to 20 carbon atoms, a substituted or unsubstituted aromatic group having from 6 to 20 carbon atoms, or a substituted or unsubstituted 3- to 15-membered heterocyclic ring with at least one atom selected from nitrogen, oxygen, sulfur, selenium, or tellurium.

4. The photographic element of claim 3 wherein A is a substituted or unsubstituted aliphatic group having 1 to 8 carbon atoms, a substituted or unsubstituted aromatic group having from 6 to 10 carbon atoms, or a substituted or unsubstituted 5- to 6-membered heterocyclic ring with at least one atom selected from nitrogen.

5. The photographic element of claim 4 wherein A is a substituted or unsubstituted aromatic group having from 6 to 10 carbon atoms.

6. A silver halide photographic element comprising a support and a silver halide emulsion layer, the emulsion layer comprising an organothiosulfonato Au(I) complex having the formula $$[A—SO_2S—Au—SSO_2—A]_n^- M^{+n}$$

wherein

M is a cationic counterion;

A is a substituted or unsubstituted organic group;

and n is 1 to 4; and wherein the compound is symmetrical around the atomic Au.

7. The photographic element of claim 6 wherein A is a substituted or unsubstituted aliphatic, aromatic, or heterocyclic group.

8. The photographic element of claim 7 wherein A is a substituted or unsubstituted aliphatic group having 1 to 20 carbon atoms, a substituted or unsubstituted aromatic group have from 6 to 20 carbon atoms, or a substituted or unsubstituted 3- to 1 5-membered heterocyclic ring with at least one atom selected from nitrogen, oxygen, sulfur, selenium, or tellurium.

9. The photographic element of claim 8 wherein A is a substituted or unsubstituted aliphatic group having 1 to 8 carbon atoms, a substituted or unsubstituted aromatic group having from 6 to 10 carbon atoms, or a substituted or unsubstituted 5- to 6-membered heterocyclic ring with at least one atom selected from nitrogen.

10. The photographic element of claim 9 wherein A is a substituted or unsubstituted aromatic group having from 6 to 10 carbon atoms.

11. The photographic element of claim 6 wherein M is an alkali metal, alkali earth metal, or ammonium cation.

12. The organothiosulfonato Au(I) complex of claim 11 wherein M is magnesium, lithium, sodium, potassium, rubidium or cesium.

13. The photographic element of claim 6 wherein the organothiosulfonato Au(I) complex is sodium bis(4-methylphenylthio-sulfonato)aurate(I).

14. The photographic element of claim 6 wherein the silver halide emulsion is greater than 95 mole % silver chloride.

15. The photographic element of claim 6 wherein the amount of the organothiosulfonato Au(I) complex contained in the silver halide emulsion is from 0.1 $\mu$mol to 500 $\mu$mol per mole of silver.

16. The photographic element of claim 15 wherein the amount of the organothiosulfonato Au(I) complex contained in the silver halide emulsion is from 1 $\mu$mol to 50 $\mu$mol per mole of silver.

17. A silver halide photographic element comprising a support and a silver halide emulsion layer, the emulsion layer having been chemically sensitized in the presence of an Au(I) complex having the formula $$[A—SO_2S—Au—SSO_2—A]_n^- M^{+n}$$

wherein

M is a cationic counterion;

A is a substituted or unsubstituted organic group;

and n is 1 to 4; and wherein the compound is symmetrical around the atomic Au.

18. The photographic element of claim 17 wherein M is an alkali metal, alkali earth metal, or ammonium cation.

19. The orgariothiosulfonato Au(I) complex of claim 18 wherein M is magnesium, lithium, sodium, potassium, rubidium or cesium.

20. The photographic element of claim 17 wherein the organothiosulfonato Au(I) complex is sodium bis(4-methylphenylthio-sulfonato)aurate(I).

21. The photographic element of claim 17 wherein the emulsion is also sensitized in the presence of hypo.

22. The photographic element of claim 17 wherein the silver halide emulsion is greater than 95 mole % silver chloride.

23. The photographic element of claim 17 wherein the amount of the organothiosulfonato Au(I) complex present during chemical sensitization was from 0.1 $\mu$mol to 500 $\mu$mol per mole of silver.

24. The photographic element of claim 23 wherein the amount of the organothiosulfonato Au(I) complex present during chemical sensitization was from 1 $\mu$mol to 50 $\mu$mol per mole of silver.

25. A method of preparing a silver halide emulsion comprising precipitating silver halide grains in an aqueous colloidal medium to form an emulsion, heating the emulsion, and adding to the emulsion, either before or during heating, an organothiosulfonato Au(I) complex having the formula $$[A—SO_2S—Au—SSO_2—A]_n^- M^{+n}$$

wherein

M is a cationic counterion;

A is a substituted or unsubstituted organic group;

and n is 1 to 4; and wherein the compound is symmetrical around the atomic Au.

26. The method of claim 25 wherein A is a substituted or unsubstituted aliphatic group having 1 to 20 carbon atoms, a substituted or unsubstituted aromatic group have from 6 to 20 carbon atoms, or a substituted or unsubstituted 3- to 15-membered heterocyclic ring with at least one atom selected from nitrogen, oxygen, sulfur, selenium, or tellurium; and M is an alkali metal or an ammonium cation.

27. The method of claim 26 wherein A is a substituted or unsubstituted aliphatic group having 1 to 8 carbon atoms, a substituted or unsubstituted aromatic group having from 6 to 10 carbon atoms, or a substituted or unsubstituted 5-to 6-membered heterocyclic ring with at least one atom selected from nitrogen.

28. The method of claim 25 wherein the silver halide emulsion is greater than 95 mole % silver chloride.

29. The method of claim 25 wherein the amount of the organothiosulfonato Au(I) complex added to the silver halide emulsion is from 0.1 $\mu$mol to 500 $\mu$mol per mole of silver.

30. The method of claim 25 wherein hypo is added to the emulsion either before or during heating.

* * * * *